US011926981B2

(12) United States Patent
Mar et al.

(10) Patent No.: US 11,926,981 B2
(45) Date of Patent: Mar. 12, 2024

(54) SCREW ANCHOR FOUNDATIONS AND RELATED INTERFACES FOR MODULAR, MANUFACTURED AND PREFABRICATED STRUCTURES

(71) Applicant: Ojjo, Inc., San Rafael, CA (US)

(72) Inventors: David Mar, Berkeley, CA (US); David Warner, Fairfax, CA (US); Tyrus Hudson, Petaluma, CA (US); Jack West, San Rafael, CA (US)

(73) Assignee: Ojjo, Inc., San Rafael, CA (US)

( * ) Notice: Subject to any disclaimer, the term of this patent is extended or adjusted under 35 U.S.C. 154(b) by 0 days.

(21) Appl. No.: 17/943,678

(22) Filed: Sep. 13, 2022

(65) Prior Publication Data

US 2023/0002999 A1 Jan. 5, 2023

Related U.S. Application Data

(63) Continuation of application No. 16/904,030, filed on Jun. 17, 2020, now abandoned.

(60) Provisional application No. 62/862,624, filed on Jun. 17, 2019.

(51) Int. Cl.
*E02D 27/16* (2006.01)
*E02D 27/32* (2006.01)

(52) U.S. Cl.
CPC ..... *E02D 27/16* (2013.01); *E02D 27/32* (2013.01); *E02D 2300/002* (2013.01); *E02D 2600/30* (2013.01)

(58) Field of Classification Search
CPC ..... E02D 27/16; E02D 2300/002; E02D 2600/30; E02D 27/32
USPC ..... 52/155–166
See application file for complete search history.

(56) References Cited

U.S. PATENT DOCUMENTS

| | | | | |
|---|---|---|---|---|
| 4,707,956 | A * | 11/1987 | Sato | E02D 5/38 52/169.9 |
| 6,665,990 | B1 * | 12/2003 | Cody | E02D 27/42 405/252.1 |
| 7,409,798 | B2 * | 8/2008 | Freeby | E04H 12/2292 52/169.8 |
| 9,207,000 | B2 * | 12/2015 | Kruse | F24S 30/425 |
| 10,077,893 | B1 * | 9/2018 | Abraham | F16B 7/105 |
| 10,508,406 | B1 * | 12/2019 | Childress | E02D 7/00 |
| 10,559,742 | B1 * | 2/2020 | Sting | F24F 1/60 |
| 11,365,845 | B1 * | 6/2022 | Carpenter | F24F 13/32 |
| 2002/0079421 | A1 * | 6/2002 | Harris | F16M 7/00 248/678 |
| 2007/0028557 | A1 * | 2/2007 | Kelly | E02D 27/34 52/741.15 |

(Continued)

FOREIGN PATENT DOCUMENTS

CN 105604086 A * 5/2016

*Primary Examiner* — Brian D Mattei
*Assistant Examiner* — Omar F Hijaz
(74) *Attorney, Agent, or Firm* — Phillip D. Mancini

(57) ABSTRACT

A foundation system for manufactured homes, prefabricated houses, and other structures. Multiple screw anchors are driven into the ground at the desired location of the structure. Preformed grade bars may be placed over the screw anchors to provide a modular foundation without pouring concrete or digging footers. Alternatively, adapters may be attached to one or more of the driven screw anchors to provide a pedestal to receive the grade bar or prefabricated sections of concrete.

11 Claims, 12 Drawing Sheets

(56) References Cited

U.S. PATENT DOCUMENTS

2008/0175673 A1* 7/2008 Roberts ..... E02D 35/00
405/230

* cited by examiner

SCREW ANCHOR FOUNDATIONS AND RELATED INTERFACES FOR MODULAR, MANUFACTURED AND PREFABRICATED STRUCTURES

CROSS REFERENCE TO RELATED APPLICATIONS

This is a continuation of U.S. patent application Ser. No. 16/904,030 titled, "Screw Anchor Foundations and Related Interfaces for Modular, Manufactured and Prefabricated Structures," filed on Jun. 17, 2020, which claims priority to provisional patent application no. 62/862,624 titled "Universal foundations, precast slabs and related interfaces for modular and prefabricated construction projects," filed Jun. 17, 2019, the disclosure of which is hereby incorporated by reference in its entirety.

BACKGROUND

There are many advantages to modular and prefabricated home construction relative to building homes onsite. For one, modular and prefabricated homes are often built indoors in climate-controlled factories rather than exposed to the elements. This keeps the materials dry as well as protecting them from theft and vandalism. It also avoids weather-related construction delays. Centralizing construction at one factory simplifies allows building materials to be delivered to a single location rather than to distributed jobsites. In addition, building inside a factory allows the use of jigs, templates, and computer-controlled machines, all of which result in structures that are built with far greater precision and consistency relative to ones that are built on-site with hand tools. Still another advantage is that an entire community or even a city may be constructed off-site, where ever resources are best utilized for this purpose and then components shipped to locations virtually anywhere in the world for final assembly.

Modular and/or prefabricated structures do still require some on-site work, but this work is typically limited to site-preparation including grading, laying or running utilities and constructing the foundation. The structures themselves are trucked in, craned on to the foundation, and connected to the utilities and the foundation. The process of closing seams and completing utility hook-ups typically takes less than a week. In some cases, even internal fixtures (e.g., plumbing and electrical) are installed at the factory.

The most time-consuming and labor intensive of onsite activities is typically construction of the foundation. After the site is graded and compacted, the soil is excavated to make room for the foundation. In some cases, a continuous trench footer is dug around the entire outline of the structure. Rebar and wire are placed in the trench then it is filled with concrete. Anchor bolts are inserted into the drying concrete or drilled and placed after it has set, and the house is built on top of it the foundation and anchors.

In other cases, the entire footprint of the structure to be built is scraped, leveled, and compacted. Then, concrete is poured over the entire compacted footprint to create a slab on which the home is built. Still further foundations use a combination of these techniques or individual concrete pads and piers whereby individual piles are excavated and constructed and piers are built on top of the pile to establish a uniform building platform. Unfortunately, there is a disconnect between the distributed, inefficient, low-precision techniques used to construct foundations and the highly efficient, centralized, precise techniques and process used to build the prefabricated and/or modular structures themselves. This can result in poor connections between structures and foundations that result in additional on-site work to conform the foundation and loss of time and money. Also, prefabricated structure builders must contract with multiple regional contractors to construct their foundations rather than simply shipping foundation components with the rest of the modular and/or prefabricated structure. In recognition of these problems, the present disclosure provides foundation systems, components and related methods that greatly simplify the process of laying a foundation for prefabricated and modular building structures and ideally eliminate or at least minimize non-utility-related onsite work.

DESCRIPTION

As discussed above, modular, and prefabricated homes offer many advantages over on-site construction. These advantages must be exploited to address the growing global shortage of quality, affordable homes. However, what is missing from the modular and/or prefabricated construction paradigm in a universal foundation that allows the structure to quickly and accurately secured to the building site regardless of soil type, without needing to excavate and pour a custom concrete foundation. Preferably such a foundation can be manufactured centrally and shipped with the other building components or at least delivered to the jobsite ready to be assembled ahead of the remaining modular and/or prefabricated components. To that end, the applicant of this disclosure has developed an A-frame-shaped truss foundation that is particularly well-suited to this application. The system is known commercially as EARTH TRUSS. The EARTH TRUSS system consists of a pair of screw anchors that are rotated into supporting ground at angles to one another and extended with above-ground upper legs that are joined with an adapter to form a unitary A-frame-shaped truss structure.

EARTH TRUSS was originally developed to support single-axis solar trackers. When wind strikes a tracker array, large lateral loads must be resisted by the foundation. With monopiles, these loads impart a bending moment onto the foundation components. By using A-frame-shaped trusses rather than monopiles, these lateral loads are instead translated into tension and compression in the legs. Because individual structural members are relatively good at resist axial loads, as opposed to resisting bending, less steel may be used to support the same size tracker.

The EARTH TRUSS relies on a specialized machine or attachment for a general-purpose machine that uses a combination of downward force and rotation to drive screw anchors into the earth. These components and machines are easily adapted to construct robust foundations for support other structures, including modular and prefabricated homes. They can be configured as a two-legged truss as with single-axis tracker foundations, or even as plumb piles depending on site conditions and sheering concerns. The present disclosure focuses on building systems and related methods that combine EARTH TRUSS components with pre-cast concrete slab sections to form fast, accurate, robust, and water-proof prefabricated foundations that can be constructed very quickly, shipped to the homesite as a kit, and assembled with minimal site preparation.

Figure 1A:
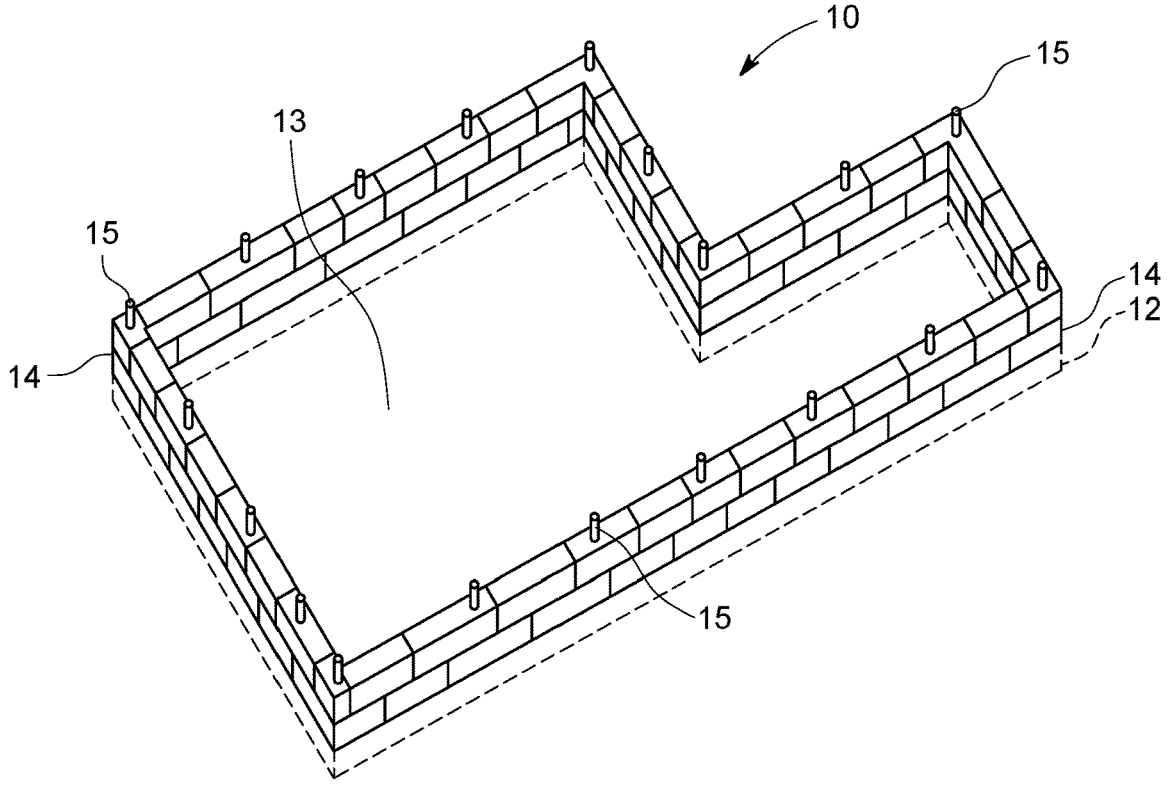
FIG. 1A (PRIOR ART)
FIG. 1A is a conventional strip footing foundation for a building structure.
Figure 1B:
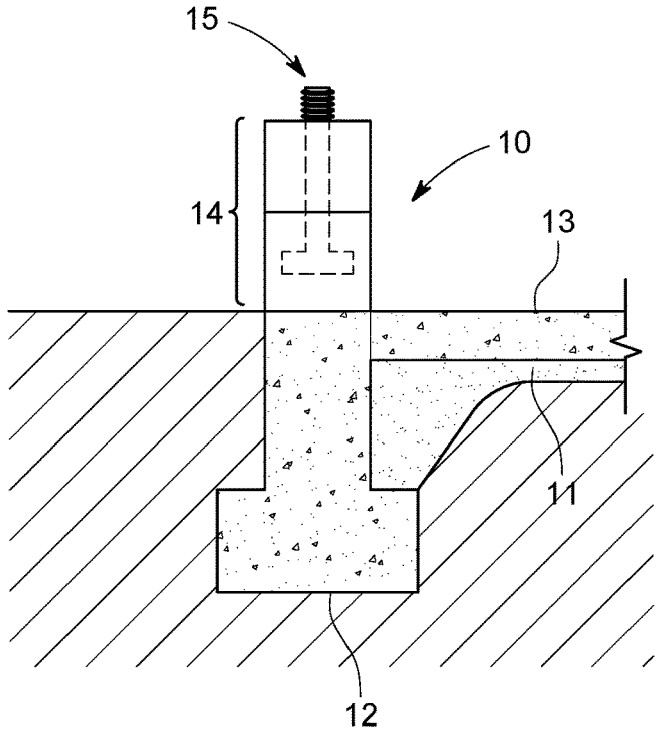
FIG. 1B is a cross sectional view of the strip footing foundation of 1A.

To that end, the present invention will now be described in the context of the drawing figures where like structures are referred to with like designations. FIGS. 1A and B show conventional strip footing foundation 10. Foundation 10 is constructed by excavating a trench around the perimeter of the intended structure (i.e., home, office, modular classroom, etc.), placing rebar, wireframe forms, and/or other reinforcing structures into the trench, and pouring concrete over them. Then concrete blocks are used to make above-ground foundation 14 on poured concrete footer 12. Gravel 11 may also be poured inside the walls of foundation 14 and a concrete slab poured on top of the gravel to create a slab such as slab 13. Anchors, ties, or other structures 15 are typically inserted into concrete block foundation 14 before it sets to provide attachment points for the rest of the structure. In the case of a modular or premanufactured homes, these anchors will serve as the points of attachment. Otherwise, if the house is built on-site, these anchors are received within wooden beams and/or floor joists, and the home is built up from there.

Figure 2A:
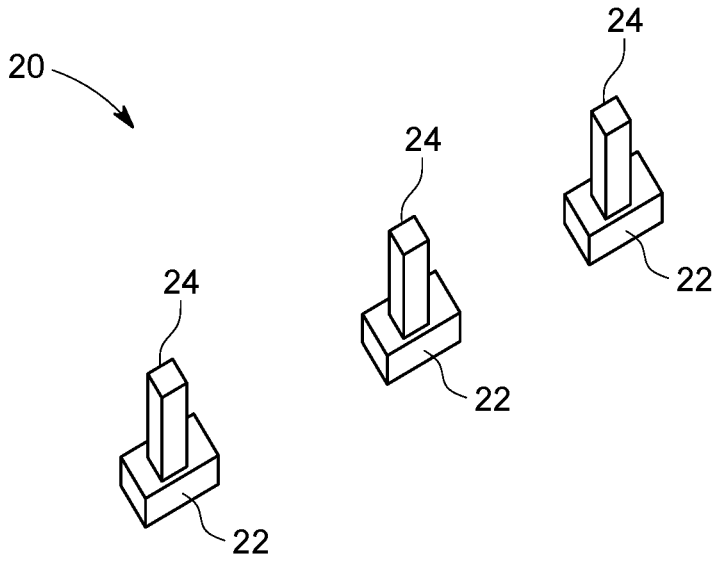
FIG. 2A (PRIOR ART)
FIG. 2A is a conventional pile and pier foundation for a building structure.
Figure 2B:
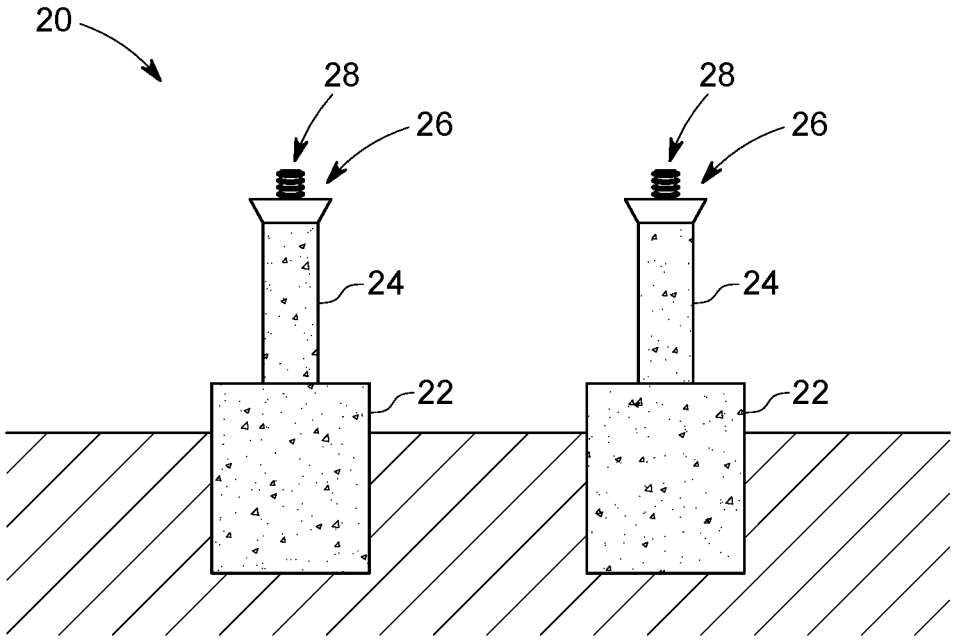
FIG. 2B is a cross sectional view of the pile and pier foundation of 2A.

FIGS. 2A and B show another conventional foundation 20 consisting of piers 24 and piles 22. In such a foundation, individual pile portions 22 are excavated at strategic points around a site to support load bearing portions of the structure in accordance with a construction plan. A wood or cardboard form may be placed around the excavated opening and wire, rebar or other structural components placed inside before filling it with liquid concrete. After pile 22 has set, concrete, wooden or steel piers 24 are constructed on top to form a level, elevated mounting surface on which to set or construct the home. Piers 24 may have cap portion 26 with integral anchor 28 that serves as the mechanical interface between the home and foundation 20.

Figure 3A:
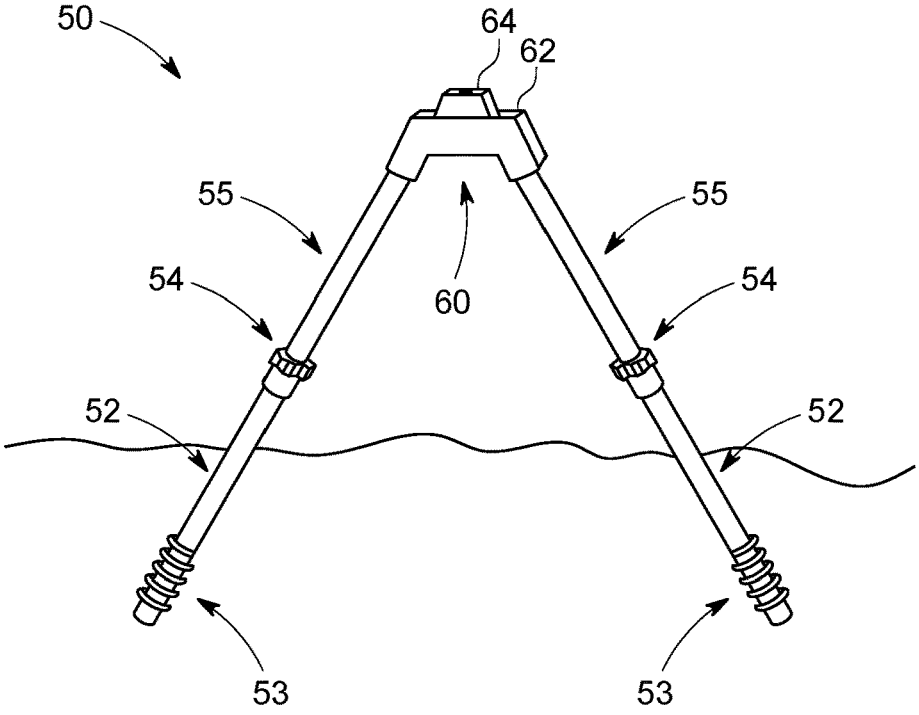
FIG. 3A is a truss foundation according to various embodiments of the invention.
Figure 3B:
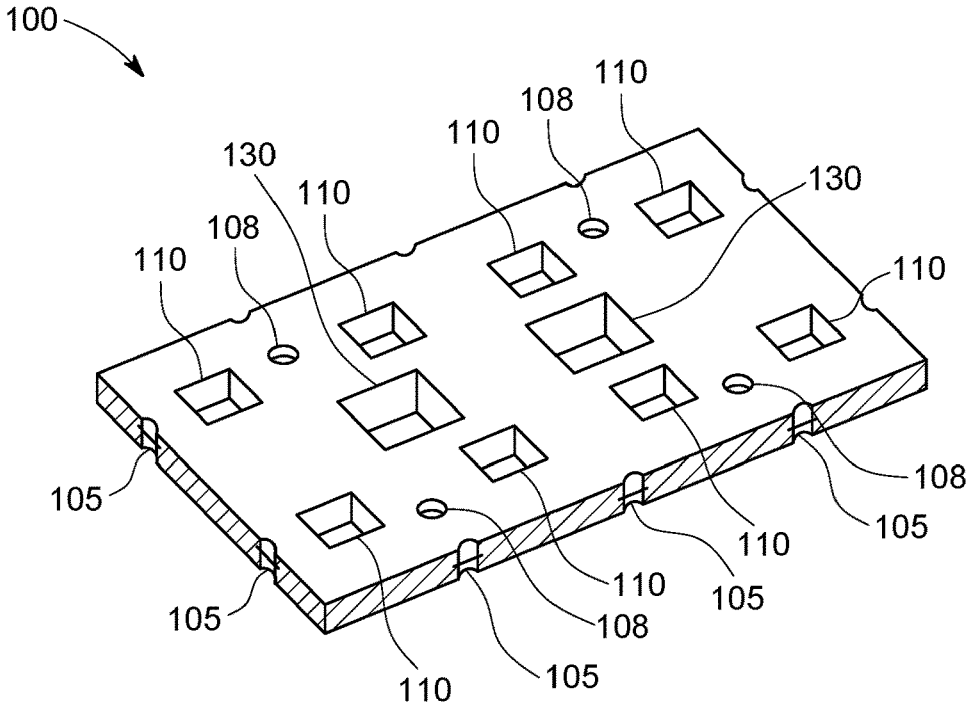
FIG. 3B is a pre-cast slab section for prefabricated and modular homes according to various embodiments of the invention.

Though first developed hundreds if not thousands of years ago, prior art foundations 10, 20 shown in FIGS. 1A/B and 2A/B continue to be used today. They require substantial onsite work with local components and labor that is completely disconnected from the manufacturing process of the modular or prefabricated structure that will be set on it other than knowing the necessary foundation dimensions. As a result, even if anchors 14/28 are positioned perfectly, something that rarely occurs, the foundation will be the least efficient or cost-effective portion of the project. Across a builder's or manufacturer's portfolio of development projects there will be varying quality and varying expense depending on many local conditions (e.g., labor rates, material availability, weather, etc.). To overcome these problems, the Applicant of this disclosure has proposed a system that allows foundation components to be centrally manufactured and shipped as a kit to the job site for rapid assembly. They may be shipped with other modular and/or prefabricated components or shipped separately beforehand, so that the entire structure, including the foundation, can be assembled on-site without pouring concrete, extensive site preparation, or excavation. FIGS. 3A and 3B show the components of this novel foundation system according to various exemplary embodiments of the invention.

FIG. 3A shows exemplary truss foundation 50 according to various embodiments of the invention. Exemplary truss foundation 50 shown here consists of a pair of screw anchors 52 driven into the ground adjacent one another and in a substantially common plane. When used to support single-axis trackers, this plane is typically oriented East to West, however, for supporting modular and prefabricated homes, they may be oriented to match the orientation of the outer walls of the structure, that is, with some trusses oriented orthogonally or at 90-degrees relative to other foundations to insure that any shearing forces are translated into tension and compression as necessary. In various embodiments, and as shown, screw anchors 52 are driven until they are almost completely embedded into the ground.

As shown, screw anchors 52 are elongated metal tubes that may span one to two meters with a sub-100 mm outside diameter. External threads 53 are located at the lower end of each anchor 52 and driving couplers 54 are attached at the opposing upper end. Driving couplers 54 may be engaged by the chuck of a rotary driver to transfer torque and downforce to screw anchors 52 to drive them into the ground. Couplers 54 may also provide a mechanism for joining upper legs 55 to the end of each screw anchor 52 after the screw anchor is driven. Upper leg sections 55 are sleeved over respective ones of driving couplers 54 to extend the axis of each screw anchor 52 above ground. It should be appreciated that depending on the required height above grade, screw anchors 52 may be used alone, that is, without needing upper legs 52. Then, an adapter or truss cap, such as adapter 60, is used to join each upper leg 55 (or screw anchor 52) to form a unitary A-frame-shaped truss foundation 50. In various embodiments and as shown, adapter 60 provides support surface 62 and may include pedestal 64, with threaded anchor bolt opening, an anchor protecting out of pedestal 64, or other structure to mechanically couple adapter 60, and by extension, foundation 50 to the structure it will support.

FIG. 3B shows pre-cast slab section 100 that makes up part of the foundation as well as the subfloor or base of the prefabricated structure according to various embodiments of the invention. In some embodiments, modular and prefabricated building components may be set directly on top of slab 100. In other embodiments, finished surfaces (e.g., radiant heat, tile, hardwood, etc.) may be installed directly on top of the pre-cast slab without needing floor trusses or a sub-floor. In various embodiments, pre-cast slab 100 is formed in regular modular shapes (e.g., 10-feet×20-feet rectangles) that can be interconnected in common or adjacent planes to form larger structures. In other embodiments, they may be formed in custom shapes to accommodate the footprint of the structure. In various embodiments, pre-cast slabs are constructed by pouring concrete into a form that has the correct outer dimensions, is filled with re-bar and/or wire, and that has protrusions that create through-holes or voids 108, 110, 130 at desired locations for the foundation interface, utility connections and/or lift points. In some embodiments, conventional concrete mixes may be used. Others may require stronger and/or more flexible formulations to accommodate the forces of cable-based post-tensioning.

In the example of 3B, a series of through holes 110 have been formed in pre-cast slab 100 at points where it will be supported by the foundations, such as, for example, foundation 50 shown in 3A. Utility through-holes 130 may be separate formed in the center of each slap 100, or elsewhere, to allow utility hookups (e.g., water, sewer, electricity, natural gas, etc. to pass through). Smaller though-holes such as holes 108 may be used as lift points to enable pre-cast sections 100 to be craned down onto an array of foundations. Perimeter cutouts 105 may be formed around the outside of each slab 100 at various points. Such cutouts 105 may be used to join one slab to an adjacent one. Cutouts 105 may also be used as lift points, obviating the need for separate holes 108. One or several of through-holes 105, 110, 130, may be reinforced with metal or preformed metal shapes that create voids as well as integral reinforced steel interface sections for mechanically interfacing the slab to the truss foundations or other structures. These shapes may be moved around within the mold before being locked into place and numbered to specifically match the foundation requirements of the particular site.

When manufacturing slab 100, a layer of PRECON or other suitable material may be laid down within the form used to make pre-cast section 100 to create a water barrier on the underside as well as up into the utility knockouts and foundation interface openings and lift points before the concrete is poured. PRECON is a composite sheet membrane manufactured and sold by W.R. Meadows of Hampshire, IL that forms a mechanical bond to poured concrete as the concrete cures. It should be appreciated that other products from other manufacturers that performs similarly may also be used. Once the concrete has set, these pre-cast sections can be loaded onto truck, train or into a shipping container with the truss members and can travel as a kit to the homesite be assembled.

Figure 3C:
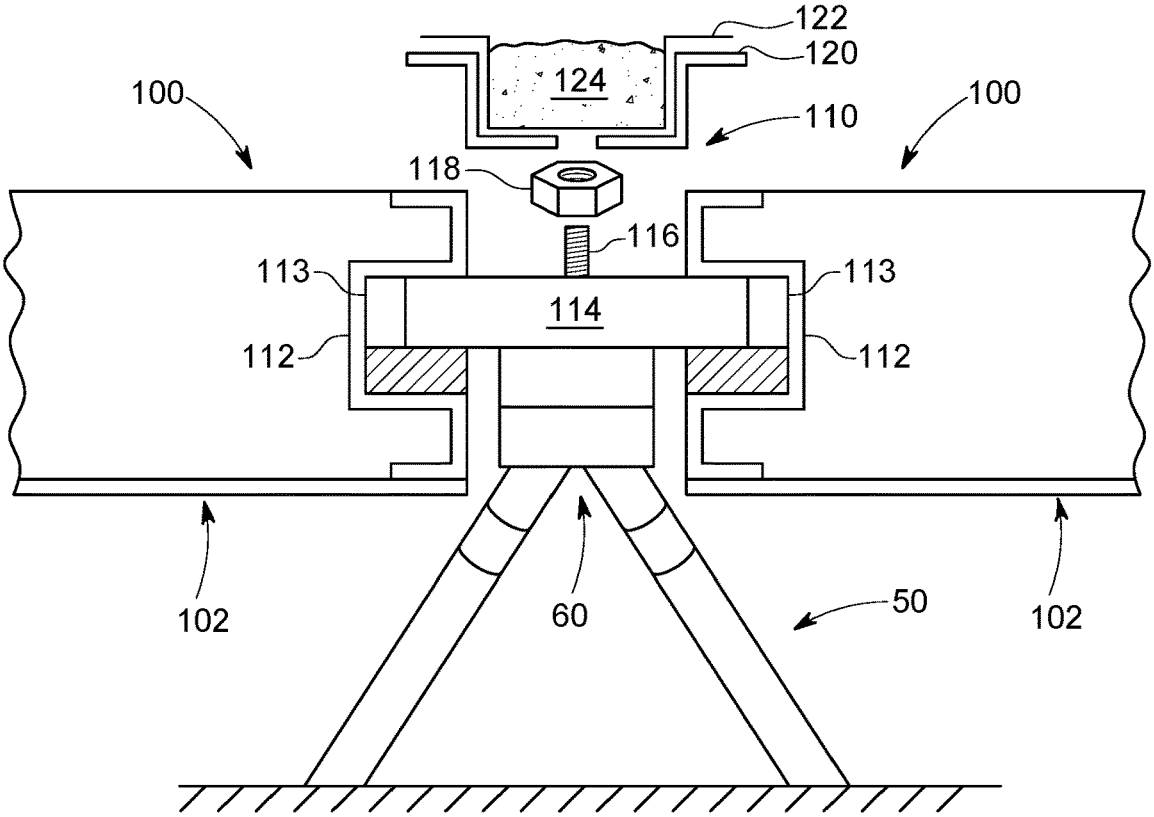
FIG. 3C is a cross sectional view of the truss interface section of the pre-cast slab and truss foundation according to various embodiments of the invention.
Figure 3D:
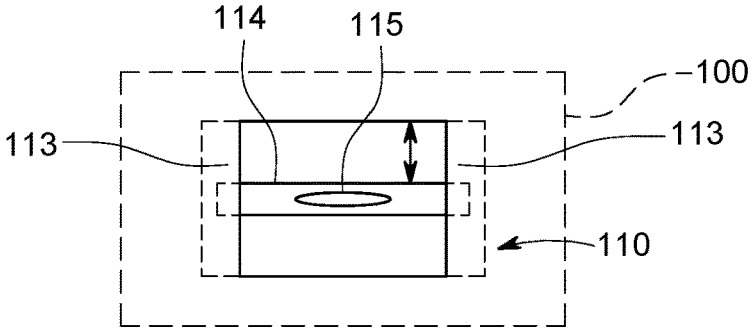
FIG. 3D is a top view of the truss interface formed in the pre-cast slab of 3C.
Figure 3E:
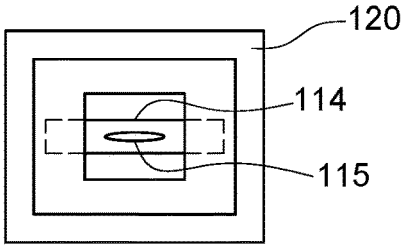
FIG. 3E is a top view of the pan covering the truss interface of 3C.

Turning now to FIG. 3C, this figure shows cross section detail of one through-hole 110 for interfacing slab 100 with foundation 50 according to various embodiments of the invention. As discussed above, slab 100 may be poured into a mold lined with a water proof barrier or membrane such as membrane 102. In this example, hole 110 consists of metal reinforced sidewalls 113 resting against walls 112. Metal reinforced sidewalls 113 may consist of a box that sits in the mold used to create slab 100. In the cross-sectional view of 3C, walls 112 and box 113 define a two-sided ledge that houses slidable transfer bar 114. In various embodiments, transfer bar 114 fits within the extended sides 112 to allow the bar to slide along the ledge in one direction (X or Y) in-plane (without movement in the Z-direction). This will enable bar 114 to be easily moved to compensate for any in-plane misalignment between the foundation through-hole 110 and adapter 60. FIG. 3D provides an overhead view of opening 110. As shown, transfer bar 114 may preferably have one or more long slots 115 formed in it to compensate for misalignment in the other planar direction orthogonal to the sliding direction of the bar. Slot 115 in transfer bar 114 as the bar's ability to move back in forth within the metal reinforced opening 113 allow compensation for up to several inches of misalignment in two direction between through-hole 110 and adapter 60 without any impact to the integrity of the connection. This will prevent foundation misalignment from propagating through the building supported by slab 100. It should be appreciated that although not shown in FIG. 3B, slab 100 may also have a series of anchors around its perimeter that project above the surface of slab 100 for connecting to the prefabricated home, modular home or other structure lowered and/or built on top of it. Such anchors can be easily placed within the mold prior to pouring the concrete so that they are correctly located.

With continued reference to FIG. 3C, anchor bolt 116 projects up through transfer bar 114 via slot 115. In various embodiments, a pan such as pan 120 is placed in through-hole 110 above bar 114. A nut such as nut 118 is used to secure pan 110 to adapter 60 via bolt 116. It should be appreciated that in various embodiments, bolt 116 may pass down from above pan 120 into adapter 60 through slot 115 in transfer bar 114. In various embodiments, after pan 120 is secured, a layer of PRECON 122 or other suitable water proof membrane may be placed in pan 120 before filling it with concrete 124, bentonite or other suitable filler to create a water proof seal.

FIG. 3D shows a portion of hole 110 looking down from above with transfer bar 114 and slot 115 visible from above. This view is consistent with the view after slab 100 has been lowered onto the foundation. Similarly, 3E shows the same view after pan 120 has been dropped into hole 110. As seen, pan 100 has a relatively large opening in its bottom to permit access to the bar at different positions.

Figure 4:
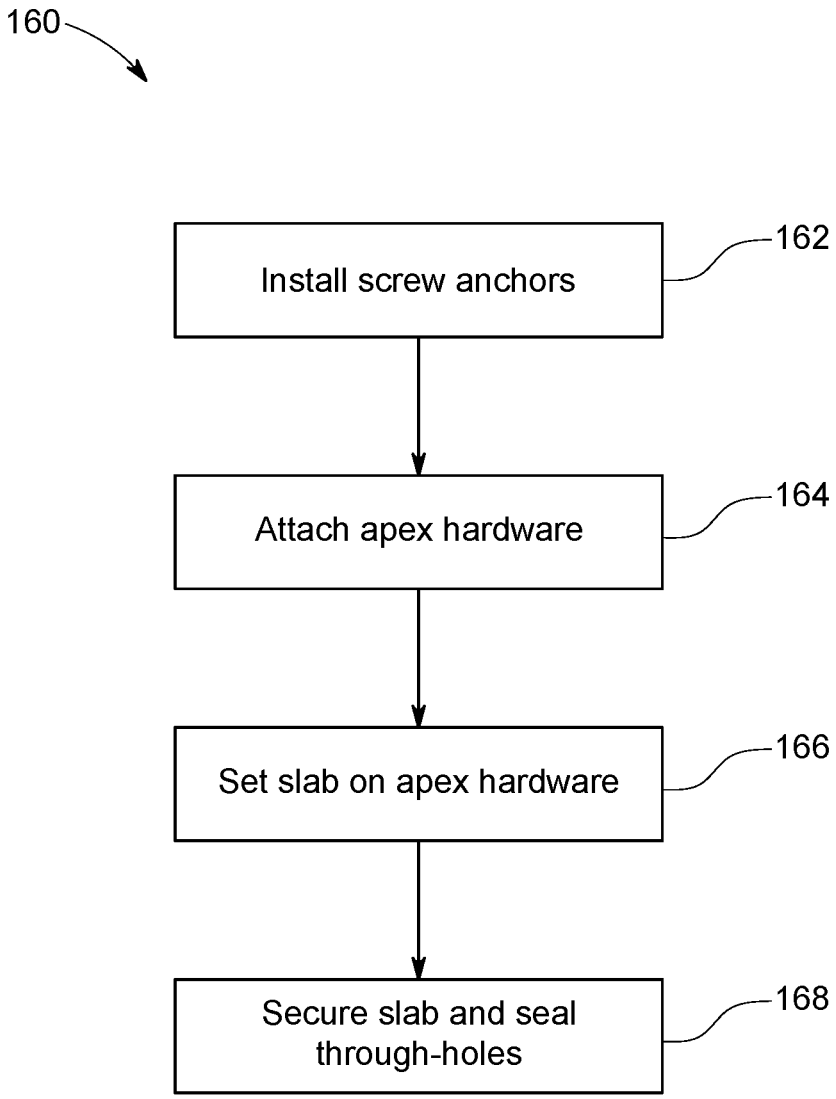
FIG. 4 is a flow chart detailing steps of a method for installing a foundation such as that shown in FIGS. 3A-E according to various embodiments of the invention.

Turning now to FIG. 4, this figure is a flow chart detailing steps of method 160 for installing a foundation such as that shown in FIGS. 3A-E according to various embodiments of the invention. In various embodiments, installation begins in step 162 by installing multiple screw anchors into the ground at the intended building site. In various embodiments, this is done in accordance with a plan matched to the manufacturing of the pre-cast slab(s) so that they foundation pedestals will match up with corresponding openings in the slab. In various embodiments, this may be accomplished by unrolling a mat or other template that has the anchor locations marked on it. The mat may also serve a vapor barrier and/or insect barrier and may be staked into the ground or otherwise attached. As discussed in greater detail herein, the screw anchors may be installed in adjacent pairs, angled towards one another to form the base of an A-frame-shaped truss foundation, or in other embodiments shown herein, as plumb monopiles.

Once the screw anchors have been driven, then, in step 164, apex hardware is installed. If necessary, this may include joining upper legs to their respective screw anchors, depending on the amount of above-ground elevation required for the particular site. If the screw anchors are installed in adjacent pairs, adapters are used to join the free end of each adjacent upper leg pair. Alternatively, if the screw anchors are driven as plumb monopiles, an upper leg is joined to each screw anchor, if necessary, and an adapter is joined to the upper end of the upper leg. In either case, in various embodiments, each adapter will include some leveling adjustment so that the adapters can be adjusted to be level to each other before being locked into place relative to the legs and/or anchors. In various embodiments, and as discussed and shown herein, the adapters may include a pedestal, anchor, or other mechanical features to mate with and secure the pre-cast slab. Then, in step 166, a crane is used to place one or more pre-cast slab sections on top of the pedestals and/or adapters in accordance with the plan. Manual manipulation of the transfer bars may be performed as the slab is lowered to allow them to be properly aligned with their respective pedestals as the pre-cast slab is being lowered. This may be accomplished by simply sliding. Alternatively, a tool may turn a cam or gear that causes the transfer bar to slide in-plane. In various embodiments, the adapter may have an anchor bolt or other fastener projecting above it that engages a slot or opening in the transfer bar. Once alignment with the respective anchors has been achieved, the entire slab may be lowered to completely rest on the supported transfer bars which, in turn, are resting on the foundation via the adapter and pedestal (see, e.g., FIG. 3C).

In various embodiments, placement of the pre-cast slab sections on the truss or monopile foundations may open up a space between the bottom side of the transfer bars and the walls of the steel reinforcement in the truss interface openings. In various embodiments, in step 168, the process is completed by securing the slab and sealing the through-holes. In various embodiments, to accomplish this an installer may reach from the top side of the slab to place a plug of bentonite clay in the gap between the transfer bar and the walls to prevent water from flowing past the transfer bar. Bentonite clay may be particular useful in this application because it remains pliable over long periods of time without losing its cohesion. It should be appreciated, however, that other materials may also be used in place or in addition to bentonite clay. For example, foam sheets or other suitable material may be placed on the ledges below the transfer bar since these lower ledges are not load bearing. Once the gap has been sealed, a pan may be dropped in each truss interface opening. The pan may have a large cutout in its bottom to account for the different positions of the transfer bar and anchor. Also, a large retaining nut may thread onto the anchor either before or after the pan is set. The nut will prevent uplift and secure the slab to the individual trusses. In various embodiments, the pan may be lined with a sheet of PRECON or other suitable material. In various embodiments, the anchor will be pressed through the layer of PRECON or an opening will be cut in it to allow the bolt to pass through. Then, a non-shrinking grout or other suitable material may be deposited in the pan. In various embodiments, this will make the truss interface watertight and prevent water and/or moisture from passing through the interface and contacting structures or components above.

It should be appreciated that in various embodiments, the pan may be omitted, and the concrete or non-shrinking grout may be poured directly on a layer of PRECON in the interface opening. In sites where water ingress is not a concern, this step may be omitted or replaced with a pest barrier to prevent bugs, termites, and/or rodents from passing through the foundation. Also, as shown in the FIG. 3C, the anchor bolt is shown as a static member that projects above the adapter. It should be appreciated that the anchor bolt may have a hexagonal or star-shaped opening in its top surface that can receive a tool to allow rotation of the bolt. In various embodiments, rotation may elevate or lower the pedestal relative to the adapter and provide a mechanism for micro-leveling the pre-cast slab after its set or to leveling the pedestal relative to surrounding pedestals before the pre-cast slab is set.

Figure 5:
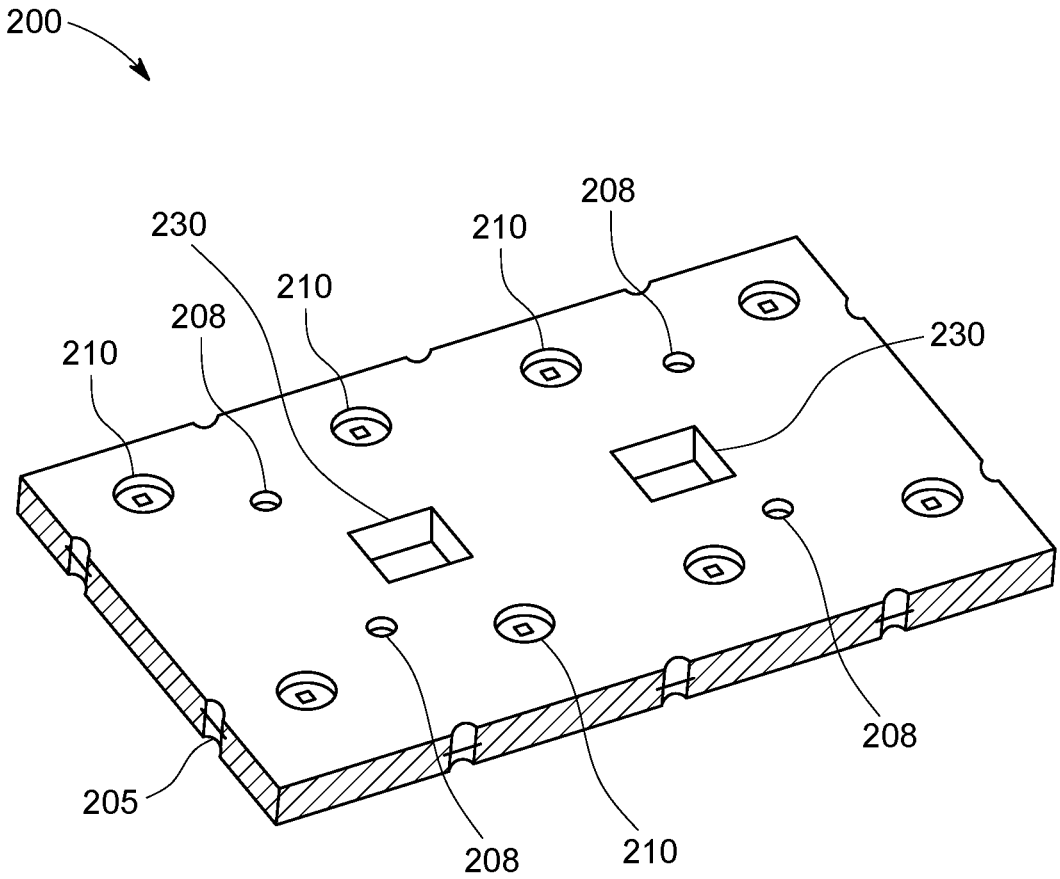
FIG. 5 is a perspective view of another pre-cast slab for prefabricated and modular structures according to various embodiments of the invention.
Figure 9A:
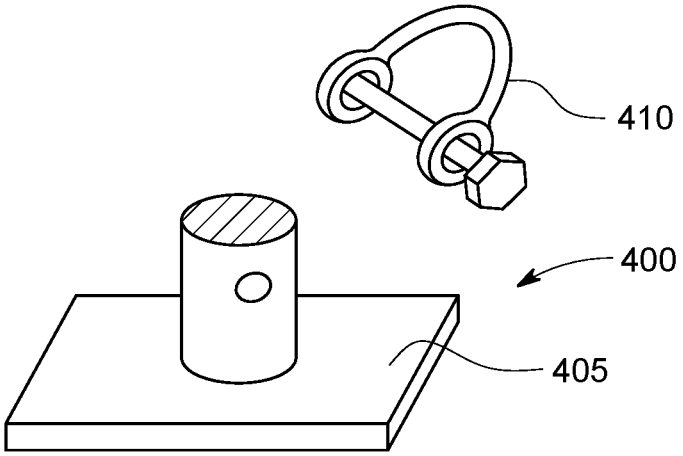
FIG. 9A is a lift plate for lifting a pre-cast slab according to various embodiments of the invention.
Figure 9B:
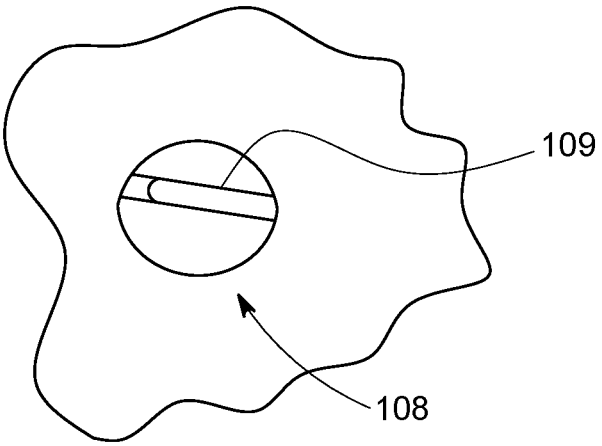
FIG. 9B is a portion of a pre-cast slab with an integrated lift point.
Figure 10:
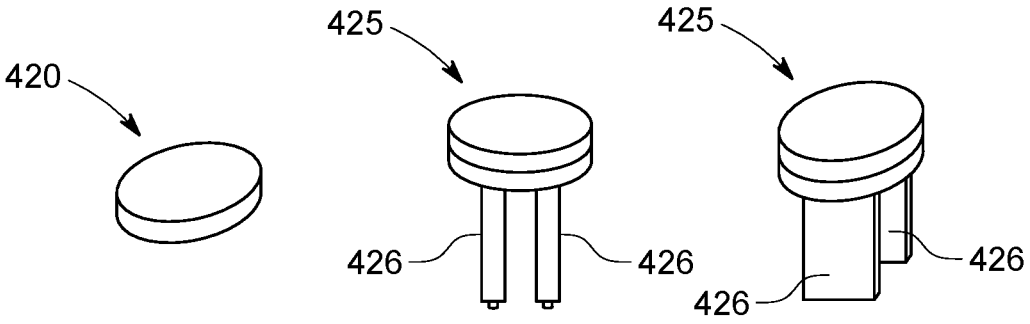
FIG. 10 is a connector for joining adjacent pre-cast slabs according to various embodiments of the invention.

Turning now to FIG. 5, this figure shows pre-cast slab 200 according to various other embodiments of the invention. Instead of the large truss interface opening in the slab of FIG. 3B/C, such as openings 110 in slab 100, foundation interface openings 210 in the slab 200 shown in FIG. 5 are formed recessed and specifically shaped to match the geometry of the pedestals supported by each foundation. In this example, the geometry of each opening is a tapered cuboid but it should be appreciated that other shapes, including pyramids, posts, cuboids, cones, etc. may be used instead. Like slab 100 shown in FIG. 3B/C, slab 200 also includes utility knock outs or openings 230 and several lift point openings 208. Lift point openings 208 could contain a reinforced metal lining and bar, as shown for example, in FIG. 9B or, alternatively, could simply be openings that receive a removable lift plate such as lift plate 405 as shown in 9A. Also, like slab 100 of FIG. 3B/C slab 200 of FIG. 5 includes several coupling joints 205 around its perimeter, which in the example, are shown as semi-circular openings with a metal bar across them. These may be used to join adjacent slabs to form a larger slab structure, such as, for example, with a connector such connector 425 shown in FIG. 10. In that case, flanges 426 will fit between the wall of the opening and the bar of adjacent slabs 200 locking them together. Alternatively, or in addition, these joints may be used to hang trim pieces, pipes, conduit, or other structures, to run communication lines, or for any other purpose. By having the foundation set back relative to the outer edge of each slab 200, trim pieces may be hung flush with the outer wall via joints 205. As with pre-cast slab 100 of FIG. 3B/C, slab 200 may also be formed with a layer of PRECON attached to its underside that extends around the sides and up into all the through-holes (e.g., lift points 208, utility knock-outs 230, and truss interface openings 210).

Figure 6A:
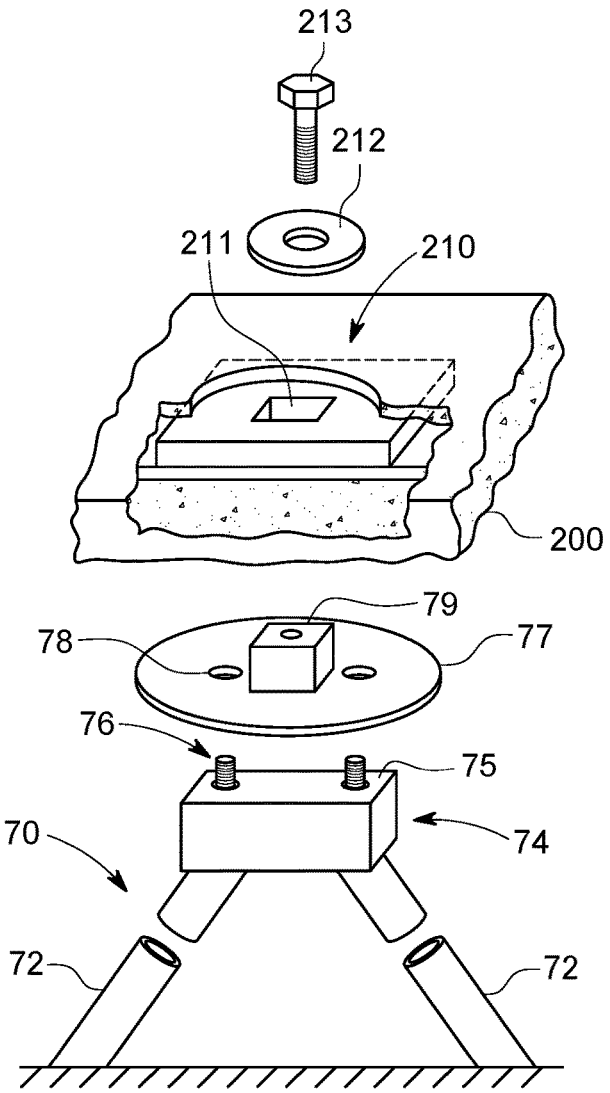
FIG. 6A is a pre-cast slab and truss foundation interconnect system according to various embodiments of the invention.

The remaining figures and corresponding discussion show interfaces that may be used to join pre-cast members to truss foundations or monopile screw anchors according to various exemplary embodiments of the invention. Starting with FIG. 6A, this figure shows a portion of pre-cast slab 200 of FIG. 5 with truss foundation 70 below it. Truss foundation 70 shown here consists of a pair of legs extending below and above ground that are angled towards one another and joined with adapter 74. In this example, support plate 77 sits on top surface 75 of the adapter 74. Support plate 77 may have a pair of holes 78 or other suitable features to enable it to be securely attached to adapter 74. Plate 77 may also have integral pedestal 79 formed on top surface. In various embodiments, pedestal 79 is attached to the plate so that it can move or pivot around the surface of the plate at different positions to enable it to be matched to the position of the corresponding void in the interface opening of the slab to compensate for any misalignment when placing slab 200. Alternatively, interface opening 210 may also be able to rotate or slide in-plane in a manner similar to the transfer bar shown in 3C so that each opening may be positioned to be directly above at and at the correct rotational orientation to receive one of the pedestals. For example, as shown in the cutaway view of 6A, the interface opening 210 may actually be constructed of a plate captured within the opening that can slide in X and Y directions and/or rotate in-plane to enable it to be oriented precisely so that opening 211 is directly above pedestal 79.

In the example of 6A, washer 212 sits above interface opening 210 after slab 200 has been lowered on to pedestals 79 to create a flat surface. An anchor bolt such as bolt 213 may pass down from above through washer 212 and into a threaded opening in the top surface of pedestal 79. Alternatively, pedestal 79 may contain an anchor protruding up above it. In such embodiments, anchor bolt 213 shown in 6A will be replaced with a retaining nut. Such modifications are within the spirit and scope of the invention. Though not shown, after slab 200 has been secured with the anchor bolt or other fastener, opening 210 containing the bolt and washer may be filled with non-shrinking grout or other suitable material to create a uniform, water resistant upper surface to slab 200.

Figure 6B:
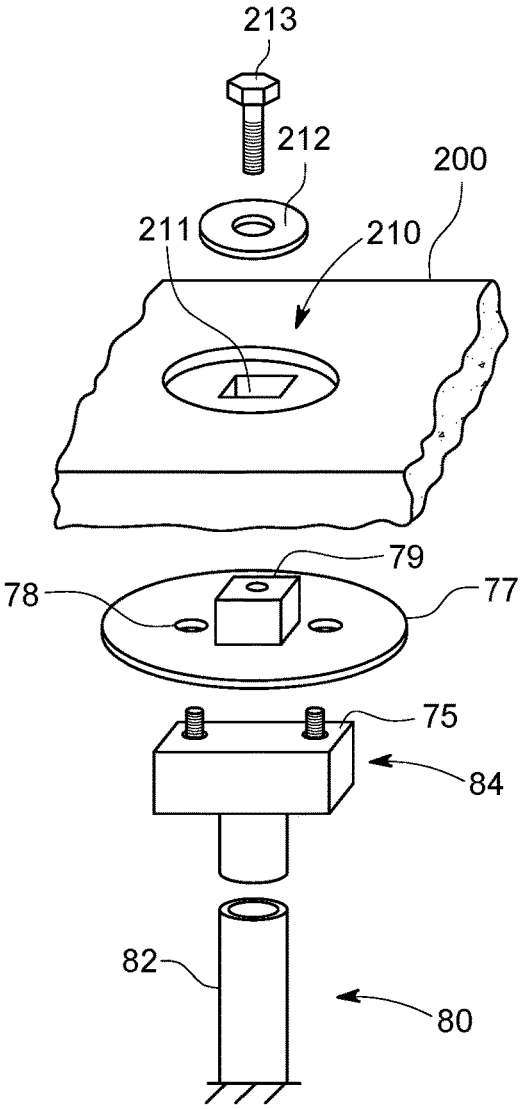
FIG. 6B is a pre-cast slab and monopile foundation interconnect system according to various embodiments of the invention.

FIG. 6B shows a slab and foundation interface like that of 5A but the truss foundation 70 has been replaced with a single, plumb-oriented monopile foundation 80. In various embodiments, monopile foundation 80 consists of a single screw anchor 82 driven substantially plumb into the supporting ground with an upper leg attached thereto, if necessary. Then, adapter 84, similar to adapter 74 shown in 6A is set on top of anchor or leg 82 and the remaining connections occur in the same manner as in the context of 6A with the same modifications possible.

Figure 7A:
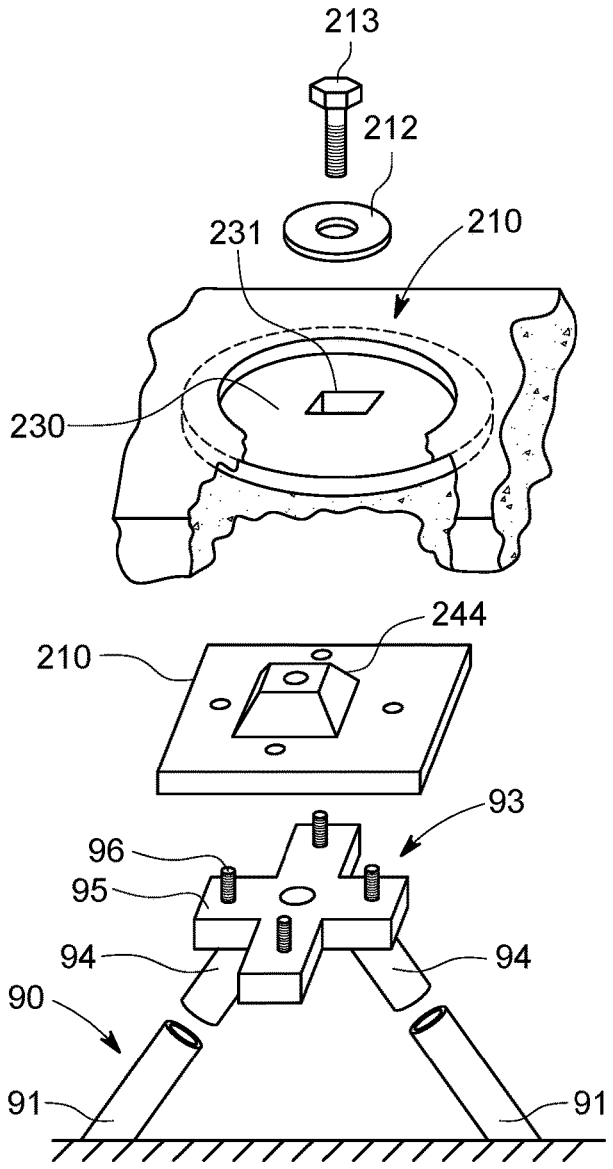
FIG. 7A is another pre-cast slab and truss foundation interconnect system according to various embodiments of the invention.

Turning now to FIGS. 7A and B, these figures show another exemplary interface between pre-cast slab 200 and screw anchor foundations according to various embodiments of the invention. Pre-cast slab portion 200 is substantially the same as that shown in FIGS. 6A and B with the same modifications possible. The differences lie in the adapter and pedestal used to support it. In the example of FIGS. 7A, adapters 93 has a cross shape with four anchor bolts 96 protruding upward towards slab 200. Support plate 240 is attached to adapter 93 so that anchor bolts 96 pass through and are secured with corresponding nuts (not shown). Pedestal 244 is formed on or attached to support plate 240 with a tapered cuboid shape. In various embodiments, cuboid pedestal 244 may be rotatable about a pivot point around the surface of plate 240 in-plane to enable pedestal 240 to be aligned with the corresponding cuboid opening 231. Alternatively, foundation interface opening 210 in the recess of slab 200 may include plate 230 that is trapped within the slab but able to rotate and/or move in the X and Y directions in-plane (without changing in the Z-direction) to ensure fitment between pedestal 244 and its corresponding opening 231. In various embodiments, washer 212 under anchor bolt 213 may be dimensioned small enough to enable it to move around within recess 210 to account for adjustment between each pedestal 244 and its corresponding opening 231.

Figure 7B:
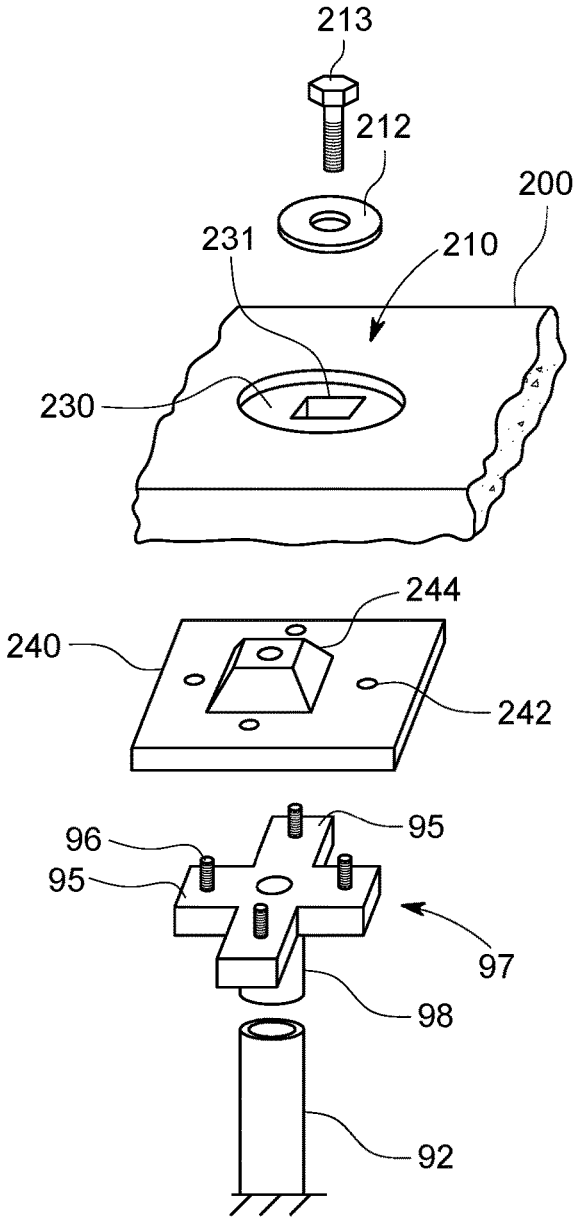
FIG. 7B is another pre-cast slab and monopile foundation interconnect system according to various embodiments of the invention.

FIG. 7B shows substantially the same interface as 7A except that truss foundation 90 has again been replaced with a plumb monopile foundation consist of single screw anchor driven 92 at a substantially plumb orientation. If necessary, an upper leg (not shown) may be attached to the above-ground end of screw anchor 92. Pre-cast slab 200 and its interface components are otherwise identical to that shown in 7A.

Figure 8A:
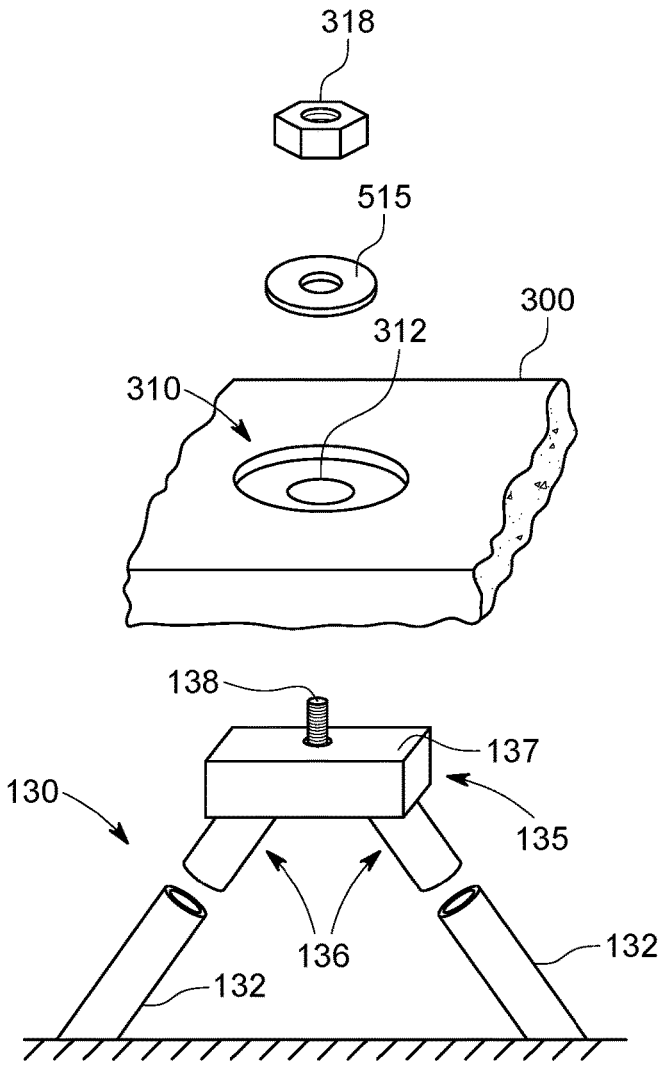
FIG. 8A is an additional pre-cast slab and truss foundation interconnect system according to various embodiments of the invention.
Figure 8B:
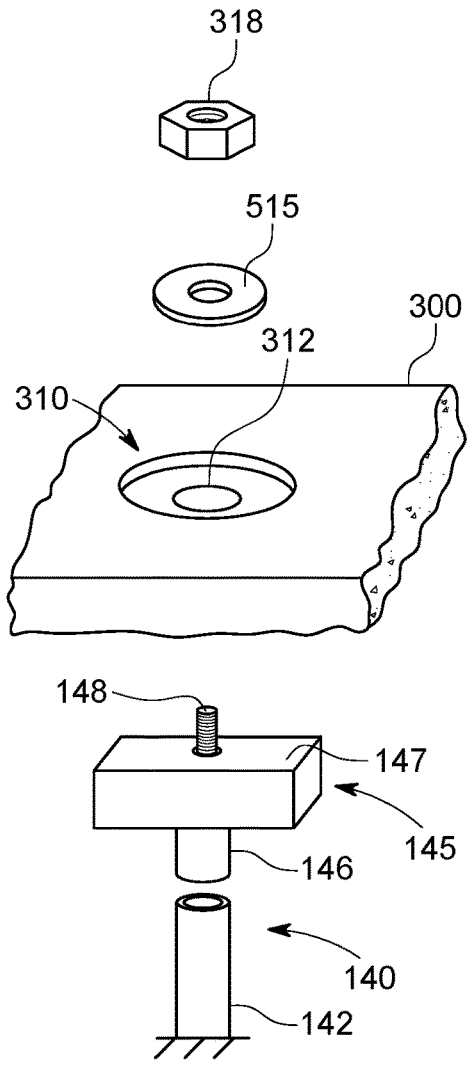
FIG. 8B is an additional pre-cast slab and monopile foundation interconnect system according to various embodiments of the invention.

Turning now to FIGS. 8A and B, these figures show yet another simplified interface between pre-cast slab section 300 and foundations 130, 140 respectively according to various embodiments of the invention. Starting with 8A, the interface shown here consists of adapter 135 with single anchor bolt 138 projecting upward from its upper surface 137. In this exemplary embodiment, anchor bolt 138 is received within interface opening 312 of recess 310 as slab 300 sits on adapter 135. Large washer 315 fits over anchor bolt 138 and retaining nut 318 is attached to the head of anchor bolt 318. Though not shown in this exemplary figure, a plate or other force spreading structure may sit atop adapter 135 to distribute the weight of pre-cast slab 300 over a larger surface area. Also, as discussed herein, anchor bolt 138 may have a hexagonal, star-shaped or other shaped opening at its head so that inserting a tool into that opening and rotating it will elevate top portion 137 of adapter 135 contacting the slab to raise (or lower) the level of the slab at that interface. This may be performed before, while, or after placing slab 300 on adapter 135. In various embodiments, opening 312 will be much larger than the diameter of anchor bolt 138 to compensate for any misalignment between bolt 138 and opening 312. Also, the size of recess 310 around opening 312 relative to the size of washer 315 will allow retaining nut 318 to be attached at multiple different X-Y locations without comprising the integrity of the connection. FIG. 8B shows a similar interface as 8A but truss foundation 130 has again been replaced with a single, plumb monopile foundation 140. The components above adapter 145 are substantially the same as that shown and discussed in the context of FIG. 8A.

Figure 11A:
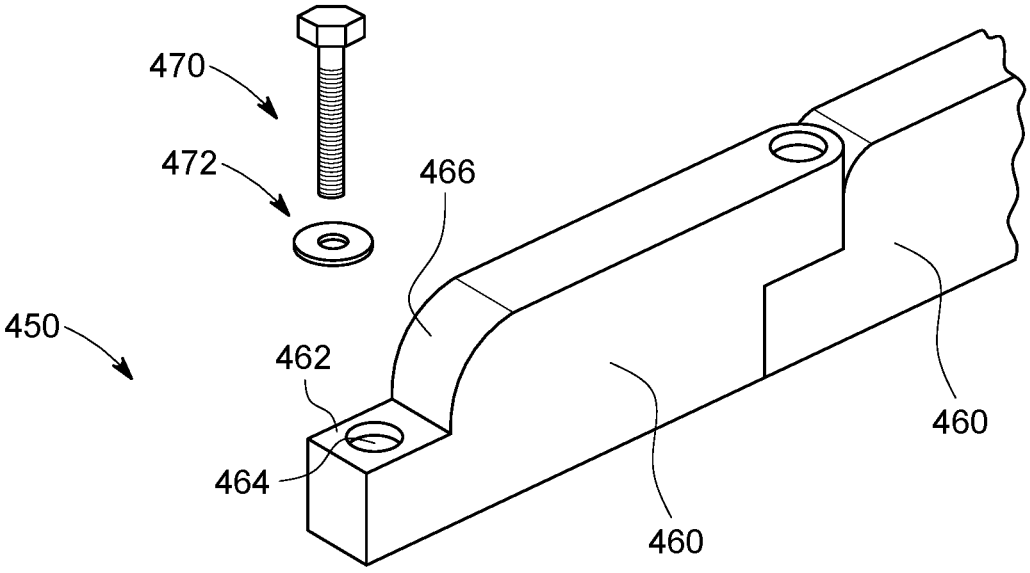
FIGS. 11A and B show components of a grade block foundation according to various embodiments of the invention.
Figure 11B:
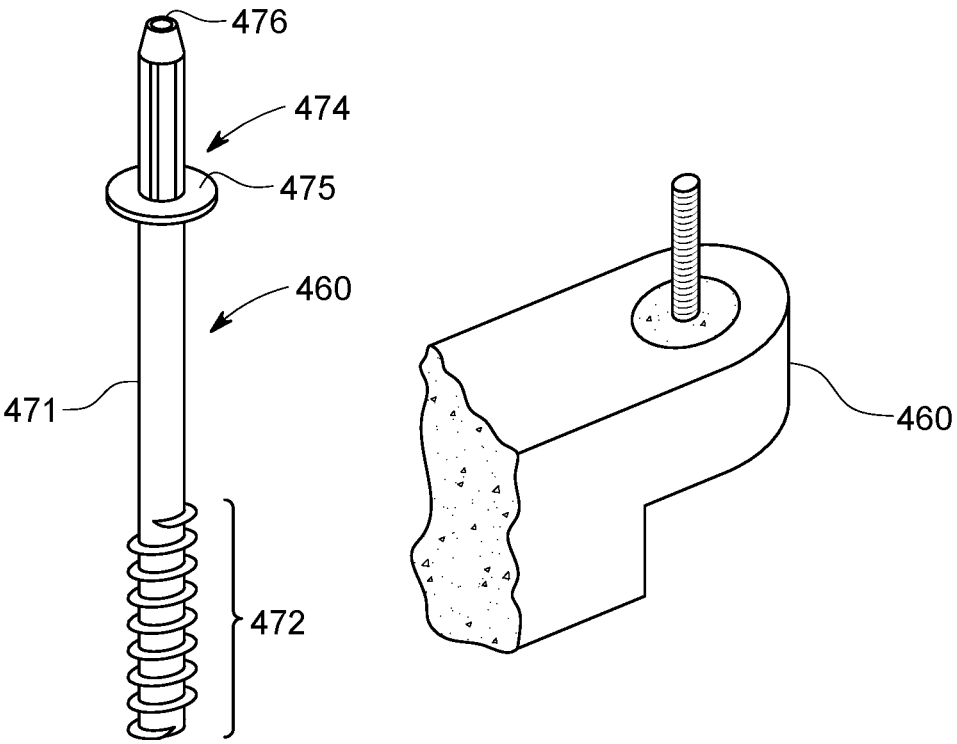

Turning now to FIGS. 11A and B, these figures show yet another foundation system according to various other embodiments of the invention. The components of system 450 include grade bar sections 460 and screw anchor members 470. Grade bar sections 460 may be formed from concrete, reinforced concrete or other aggregate solution that is poured into a mold and hardened. In various embodiments, the sections are universal. In other embodiments, they may be formed to specific dimension and numbered or otherwise marked with indicia matching to foundation plan for the structure. Each section 460 may include on more through-holes that enable them to be securely connected to one another and to top end 474 of anchors 470. In various embodiments, and as shown in 11A, transition portion 466 of the bar may have a curved surface to enable the next adjacent section 460 to be oriented at an angle relative to that one so long as openings 464 on surface 462 line up.

In various embodiments, bolt or fastener passes through washer 472 into opening 464 is received in threaded opening 476 in head portion 474 of screw anchor 470. The bottom side of section 460 will rest on support surface 475 to maintain level. In various embodiments, head portion 474 may be rotatable with a socket type tool to raise or lower head portion 474 including support 475 to adjust the level of section 460 after it has been placed on screw anchor 470. Also, as seen in 11B, after adjacent sections have been joined via bolt 470 to other means, an anchor such as anchor 482 may be inserted above bolt 470 in hole 464 and then remainder of the hole filled with grout 482 or other suitable material. In various embodiments, opening 464 will be large enough to enable anchor bolt 480 to be moved around to the proper orientation to mate with the remainder of the structure to be placed on or built above grade bars 460.

In various embodiments, grade bar sections 460 will be designed based on the specific plans for the structure to be erected so that anchor bolts are located at the desired locations. Also, it should be appreciated that adjacent sections of grade bar may be joined directly, that is, not via the ground penetrating screw anchor. In other words, each grade bar sections may be placed on top of one or more screw anchors but the connection between adjacent sections may be made with hardware that only penetrate the two overlapping sections and does not extend down into the supporting ground below.

Figure 12:
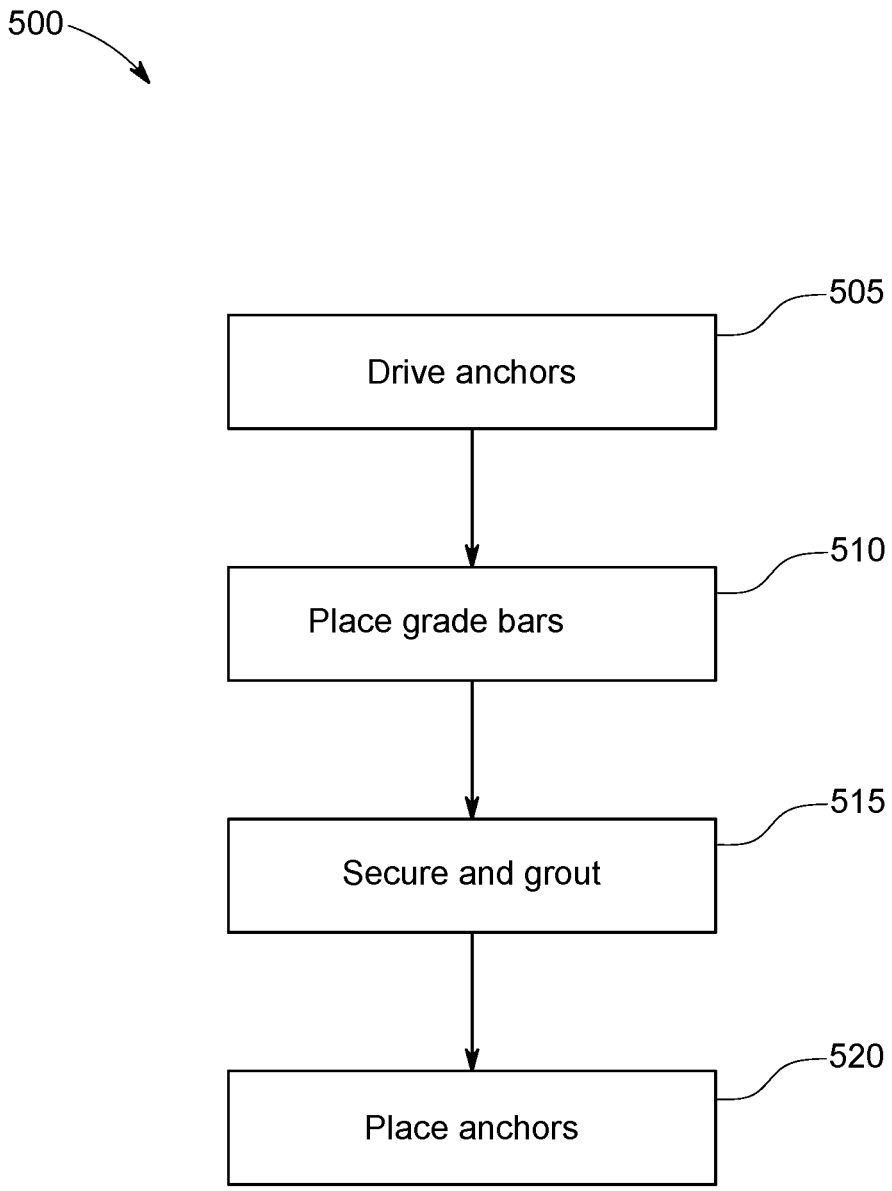
FIG. 12 is a flow chart detailing steps of a method for installing a foundation such as that shown in FIGS. 11A and B according to various embodiments of the invention.

FIG. 12 is a flow chart detailing the steps of a method for installing a foundation system such as that shown in FIGS. 11A and B. Method 500 begins in step 505 where the various anchors used to make up the foundation are installed. As discussed herein, this may comprise rotating them into the ground with a rotary driver using a combination of downforce and torque at precise locations indicated in the foundation plan. The anchors may extend around the perimeter of the structure only, or alternatively may also intermittently pass through the middle connecting sections of the perimeter, as necessary. In various embodiments, anchors are driven at a plumb orientation or orthogonal to the desired placement of the grade bars so that the height of the top end of each anchor is very consistent relative to other anchors in the same foundation.

Next, in step 510, after all the screw anchors have been consistent driven in accordance with the foundation plan, the grade bars are laid down above the anchors. In various embodiments, this is accomplished by hoisting each grade bar section with a crane and lowering is so that at least one opening formed in the bar aligns with the head a corresponding one of the screw anchors. The bar is lowered until it rests on the support portion in the head of the screw anchor. As discussed in the context of FIGS. 11A and B, it may be possible to rotate the head of the anchor with tool to raise or lower the support portion, thereby raising or lowering the grade bar to be level. This process may be repeated until each grade bar making up the foundation has been placed on the screw anchors.

Next, in step 515, each bar is secured to its adjacent bar. As discussed above, in some embodiments, screw anchors may pass through the grade bars at the overlap joint between each bar, obviating the need for this step. In other embodiments, however, separate hardware may be passed through the overlapping portions of each adjacent bar to lock them together. Then, each opening passing through the bars, whether to join two adjacent bars, connect the bars to their respective screw anchors, or both, are filled with grout or other suitable material to seal them. Joint between adjacent bars may also be grouted and/or insulated to prevent ingress of water, air, and insects. Then, the process is completed in step 520 by placing anchor bolts or other tie-in structures in the grouted openings to support the structure that will be set on or built above the foundation.

The various foundations and pre-cast slabs shown herein will provide a modular, transportable, precise, and easily installed system that will rapidly increase the deployment of modular and prefabricates homes and other structures. They will also provide a uniform and predictable foundation that can very accurately and consistently predict foundation costs on a per square foot basis regardless of site conditions and with minimal pre-constructions site preparation.

The embodiments of the present inventions are not to be limited in scope by the specific embodiments described herein. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims. Further, although some of the embodiments of the present invention have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breath and spirit of the embodiments of the present inventions as disclosed herein.

The invention claimed is:

1. A foundation system for modular and prefabricated homes comprising:

a plurality of truss foundations, each truss foundation comprising a pair of legs that are driven into supporting ground and angled towards one another; and a precast slab section that is attached to the plurality of truss foundations at pre-formed through-holes, wherein each pre-formed through-hole comprises a box containing a transfer bar, slidably positioned within the box, and a sealant pan above the transfer bar with a waterproof membrane in the sealant pan.

2. The foundation system according to claim 1, wherein each truss foundation comprises an adapter, the adapter joining each pair of truss legs and including a pedestal for supporting the precast slab section.

3. The foundation system according to claim 1, wherein the transfer bar includes at least one slot for receiving an anchor bolt.

4. The foundation system according to claim 1, further comprising a volume of water blocking material in each pan above the waterproof membrane.

5. The foundation system according to claim 1, further comprising a volume of bentonite positioned in each through-hole beneath the transfer bar to prevent the ingress of water.

6. The foundation system according to claim 1, further comprising a plurality of lift points formed in the precast slab section.

7. A method of forming a foundation comprising:

driving a series of screw anchors into supporting ground at predetermined positions;

attaching adapters to the screw anchors;

placing a pre-cast slab on the adapters so that the adapters align with holes formed in the pre-cast slab;

securing the pre-cast slab to the adapters; and placing a pan in each hole formed in the pre-cast slab, lining the pan with a waterproof membrane, and filling the lined pan with a water blocking material to prevent water from passing from under the pre-cast slab to above the pre-cast slab via the holes.

8. The method according to claim 7, wherein attaching the adapters to the screw anchors comprises attaching an adapter to an above-ground end of each driven screw anchor, the adapter including a pedestal for supporting the pre-cast slab.

9. The method according to claim 7, wherein driving the series of screw anchors comprises driving the series of screw anchors in angled pairs at predetermined positions under an intended location of the pre-cast slab.

10. The method according to claim 9, wherein attaching adapters to the screw anchors comprises attaching an adapter to an above-ground end of each angled pair of screw anchors, the adapter including a pedestal for supporting the pre-cast slab.

11. The method according to claim 7, wherein placing the pre-cast slab on the adapters so that the adapters align with the holes formed in the pre-cast slab comprises aligning transfer bars in each hole with a pedestal formed on each adapter.

* * * * *